United States Patent [19]

Sremba et al.

[11] Patent Number: 4,875,708

[45] Date of Patent: Oct. 24, 1989

[54] BOOK SHADE

[75] Inventors: Gerald F. Sremba; Patricia M. Sremba, both of 18281 Fernando Cir., Villa Park, Calif. 92667; James P. Sullivan, Orange, Calif.

[73] Assignees: Gerald F. Sremba; Patricia M. Sremba, both of Villa Park, Calif.

[21] Appl. No.: 107,984

[22] Filed: Oct. 13, 1987

[51] Int. Cl.[4] ..... B42D 3/00; B42D 9/00; A45C 9/00

[52] U.S. Cl. ..... 281/45; 281/41; 190/1

[58] Field of Search ..... 281/1, 42, 45, 46; 160/134, 105, 106, 110; 24/455; 190/1; 2/12

[56] References Cited

U.S. PATENT DOCUMENTS

| | | | |
|---|---|---|---|
| 1,841,741 | 1/1932 | Labadie | 190/1 |
| 2,489,553 | 11/1949 | Wofford | 190/1 |
| 2,822,847 | 2/1958 | Cesaroni, Jr. | 190/1 |
| 2,984,205 | 5/1961 | Richards . | |
| 3,298,477 | 1/1967 | Martinez | 190/1 |
| 3,416,817 | 12/1968 | Gia-Quinto | 281/42 |
| 3,724,617 | 4/1973 | Lawler | 190/1 |
| 3,833,098 | 9/1974 | Alderman | 190/1 |
| 4,180,112 | 12/1979 | Bovet . | |
| 4,241,745 | 12/1980 | Knox . | |

*Primary Examiner*—Frank T. Yost
*Assistant Examiner*—Paul M. Heyrana
*Attorney, Agent, or Firm*—Knobbe, Martens, Olson & Bear

[57] ABSTRACT

A book shade having flaps that can be inserted into a book to hold the shade, and positioning means to position the shade at an acute angle with respect to the pages of the book. Resilient means help hold the book pages in an open position. In another embodiment, a bottom cover contains an open book, while a top cover is held in a selected position with respect to the book so as to shade the book. Springs on the bottom cover urge the pages to remain open at selected pages. The top cover can be placed substantially parallel to the bottom cover in a closed position when the book is not in use.

3 Claims, 3 Drawing Sheets

Fig. 3
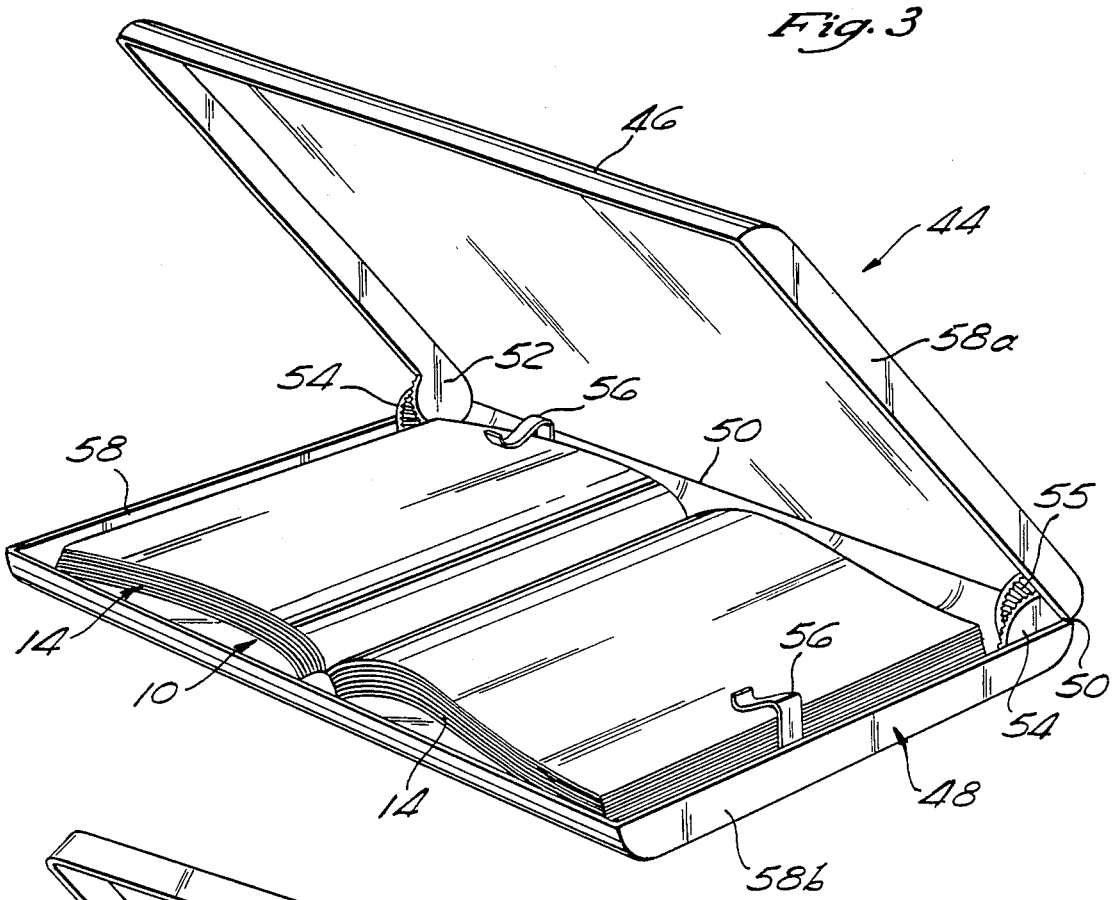
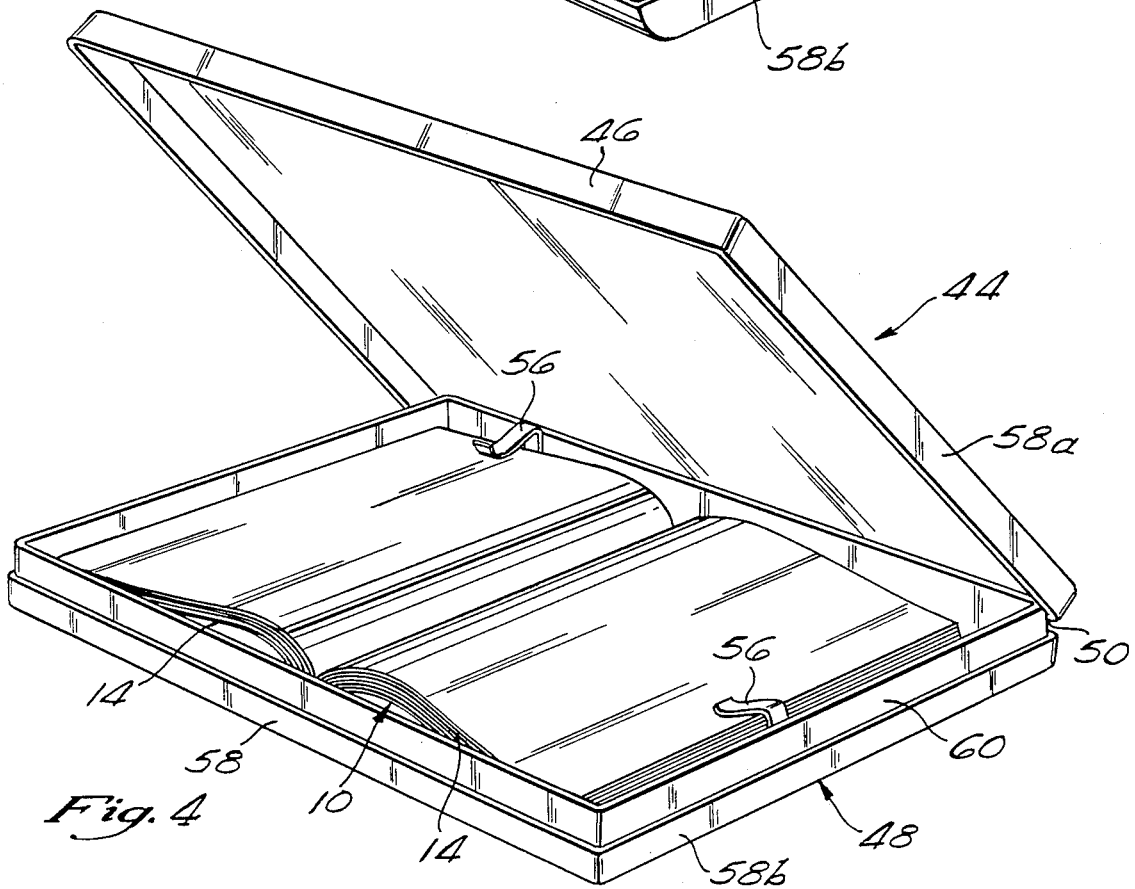
Fig. 4

Fig. 5
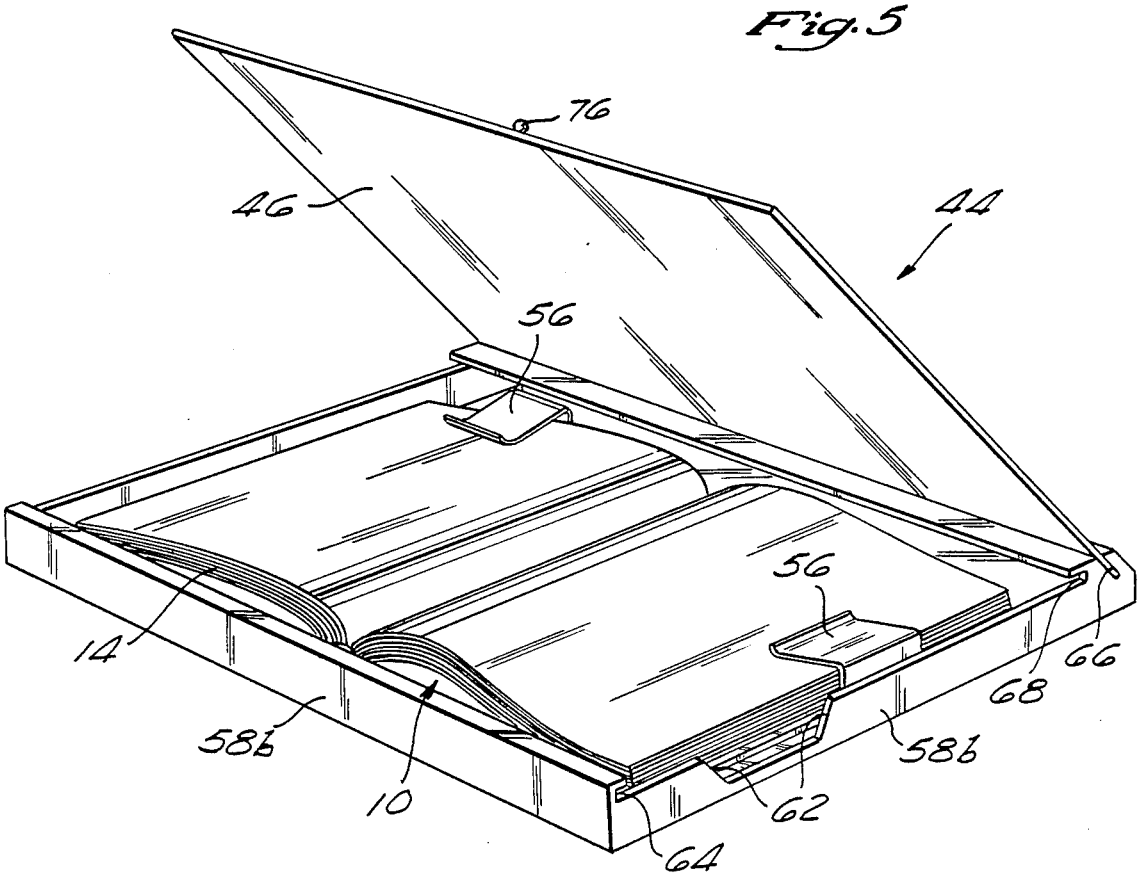
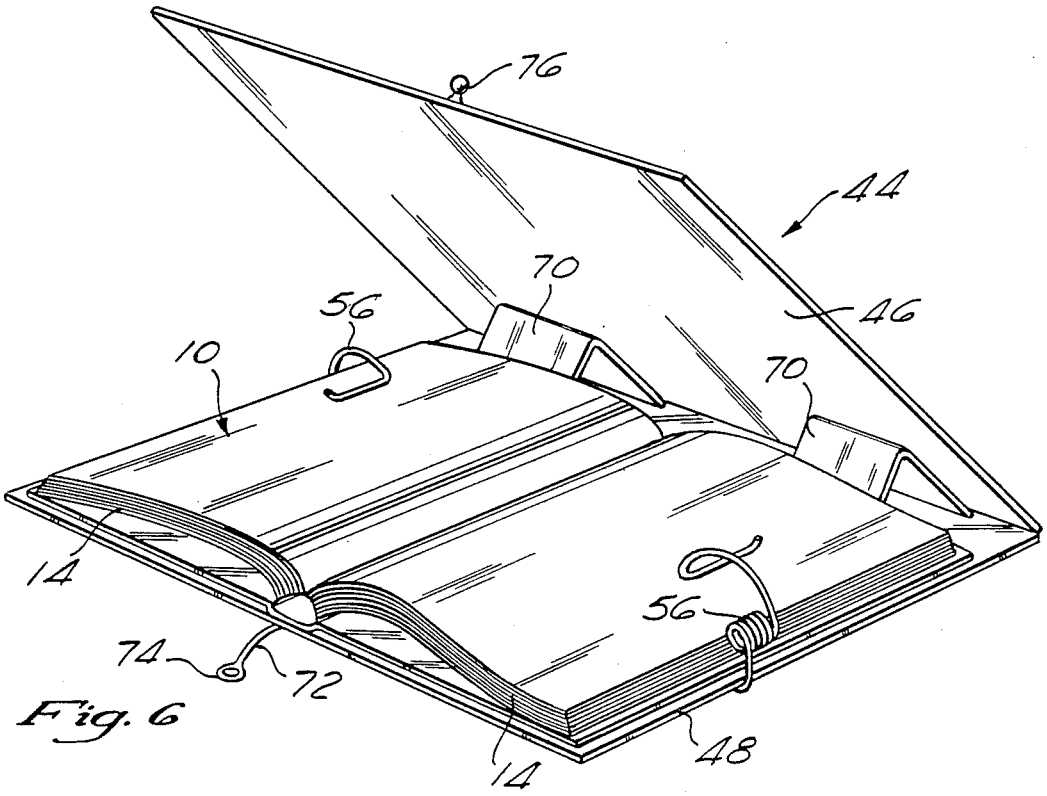
Fig. 6

BOOK SHADE

FIELD OF THE INVENTION

This invention relates generally to books and reading materials, and specifically to an apparatus used to prevent the offensive glare of sunlight on the text of the reading materials which can reflect light into the reader's eyes, thereby not only making the reader uncomfortable, but making it difficult to read the text printed on the materials.

BACKGROUND OF THE INVENTION

A wide variety of bound reading materials are currently used, be they hard cover books, paperback books or magazines. These reading materials are sometimes printed in small print which can strain a reader's eyes. Further, these reading materials are occasionally printed on paper having a highly reflective surface. It is not uncommon, therefore, for the pages of the reading material to reflect the incident light into the reader's eyes, causing a glare which makes the printed text difficult to read.

This glare causes undesirable eye strain and also lowers the contrast between the print and the paper, further making it more difficult to read the printed material. The glare problem becomes significant when the reading materials are taken outdoors, since the sun is a single point of illumination and the pages of the reading materials can reflect a significant amount of sunlight into the eyes of the reader.

There is thus a need for a means to control the reflection of incident light into the eyes of the reader on these types of printed materials.

When reading books outdoors, whether in the back yard, at the beach or in the park, the books tend to get dirty not only during transit but from exposure to the environment. Similar problems occur indoors, although to a lesser extent. Thus, a number of book jackets have been devised which typically comprise a sheet of paper which covers the exterior of the book, but which leaves the edges of the pages unprotected. These book jackets typically become worn, torn or discarded so that the book binding, cover and pages are soiled or damaged. There is thus a need for an improved book cover to address these problems.

When a large number of pages are tightly bound together by a binding, the binding tends to exert a force on the pages which urges them to turn of their own accord when the book is opened. Since it is difficult to read moving pages, the reader typically holds the book open to the page that is being read. Tightly bound pages also tend to form an arch which makes it difficult to read the text on the curved pages. To further reduce this self-paging tendency of the books, and to hold the pages flat for reading, it is not uncommon for the reader to bend the book backwards so as to break the binding of the book and thereby reduce the tendency of the pages to turn by themselves, and to arch. This practice is damaging to the book binding and reduces the value of the books. There is thus a need for an improved means of retaining a book open at a desired location without necessarily damaging the book binding.

SUMMARY OF THE INVENTION

Briefly described, a book shade is provided that is removabely attached to a book and which supports a positionable shade to prevent glare from light incident on the pages of the book. There is thus a shade sufficiently opaque to obstruct at least a substantial portion of the light incident on a page of an open book; support means for supporting the shade in a position relative to the open book where preferably the support means are substantially flat and about the same size as the open book; and connecting means for removeably fastening the support means to the book.

An apparatus is thus provided for aiding in reading books, where the books have a cover, a plurality of pages, and a binding connecting the pages and cover. The apparatus comprises two flaps, spaced apart sufficiently to accommodate the binding of the book, the flaps being sized to permit the flaps to be inserted between the pages of the book and the cover yet permitting the book to lay open for reading; a shade connected to the flaps so as to allow the shade to be positioned at an acute angle with respect to the flaps, the shade being sized so as to obstruct a desired amount of light incident on the pages of an open book when the flaps are inserted into the book; and means for controlling the position of the shade to adjust the amount of light obstructed by the shade.

Preferably, the apparatus further contains resilient means for urging the shade toward the flaps, with the resilient means taking the form of elastic members. In a further embodiment, the apparatus contains stiffening means for providing localized stiffness to at least one portion of the shade. Preferably, the stiffening means can be selectively positioned to provide a selectable amount of stiffness to the shade. The shade is preferably opaque, but in alternate embodiments, at least a substantial portion of said cover is semi-transparent.

Thus there is broadly described positionable shade means for shading the pages of an open book from incident light; and insertable support means for holding the shade means in the open book, the support means being insertable into the pages of the book to hold the shade means while still allowing the book to lay open for reading.

In yet another embodiment of the apparatus, there is provided a book shade for holding an open book having a plurality of pages, and shading the pages from incident light, comprising a top cover and bottom cover moveably connected together adjacent a first edge of the covers, the covers being sized substantially the same as an open book of predetermined dimensions when the covers are substantially parallel to one another in a closed position and adjacent said open book; and holding means for holding the top cover in at least one selected position at an acute angle with respect to the bottom cover in order to block light incident on the pages of an open book placed between the covers.

Preferably this last alternate embodiment has retaining means for retaining the pages of the book open at selectable pages. A still more preferable embodiment comprising sides on the top and bottom covers cooperating with the covers to form an enclosure substantially enclosing an open book placed between the covers when the covers are in the closed position.

In a final embodiment of the invention, the book shade for shading the pages of an open book from incident light, comprises a substantially flat bottom cover having a first and second, substantially parallel edges on opposite sides of the cover; first and second projections extending in the same direction from the first and second edges, respectively, the first and second projections having first and second apertures therein, respectively, and having openings to the apertures that face one another, one of the projections having a third aperture therein; a substantially flat top cover having at least a portion of a first edge that can be removeably inserted into the third aperture, the shape of the top cover and the first edge of the top cover cooperating with the orientation of the third aperture to position the top cover at an acute angle with respect to the bottom cover when the top cover is inserted into the third slot so as to shade a book resting on the bottom cover from incident light, the top cover having a second edge such that at least a portion of the first and second edges of the top cover can be removably inserted into the first and second slots, the projections extending from the bottom cover a distance such that an open book can remain between the top and bottom covers when the first and second edges of the top cover are inserted into the first and second slots.

There is thus provided a positionable book shade for reducing the glare incident on the pages of a book. The shade can be supported by a simple insert held by the book, or the support can take the form of a protective container holding the book. In either case, the glare from the book is reduced to facilitate reading, especially reading in the outdoors where the glare from the sun is pronounced.

BRIEF DESCRIPTION OF THE DRAWINGS

Advantages of the invention will become apparent to those skilled in the art from the following description, considered in conjunction with the drawings (like numbers refer to like parts throughout), and wherein:

FIG. 3 is a perspective view of a further embodiment of the book shade of this invention forming a container for the book.

FIG. 4 is a perspective view of a further embodiment of the book shade of FIG. 3 having interlocking edges on the sides of the container.

FIG. 5 is a perspective view of a further embodiment of the book of this invention having a removable top cover.

FIG. 6 is a perspective view of a further embodiment of a book shade of this invention having a flexible top cover.

DETAILED DESCRIPTION OF THE INVENTION

Figure 1:
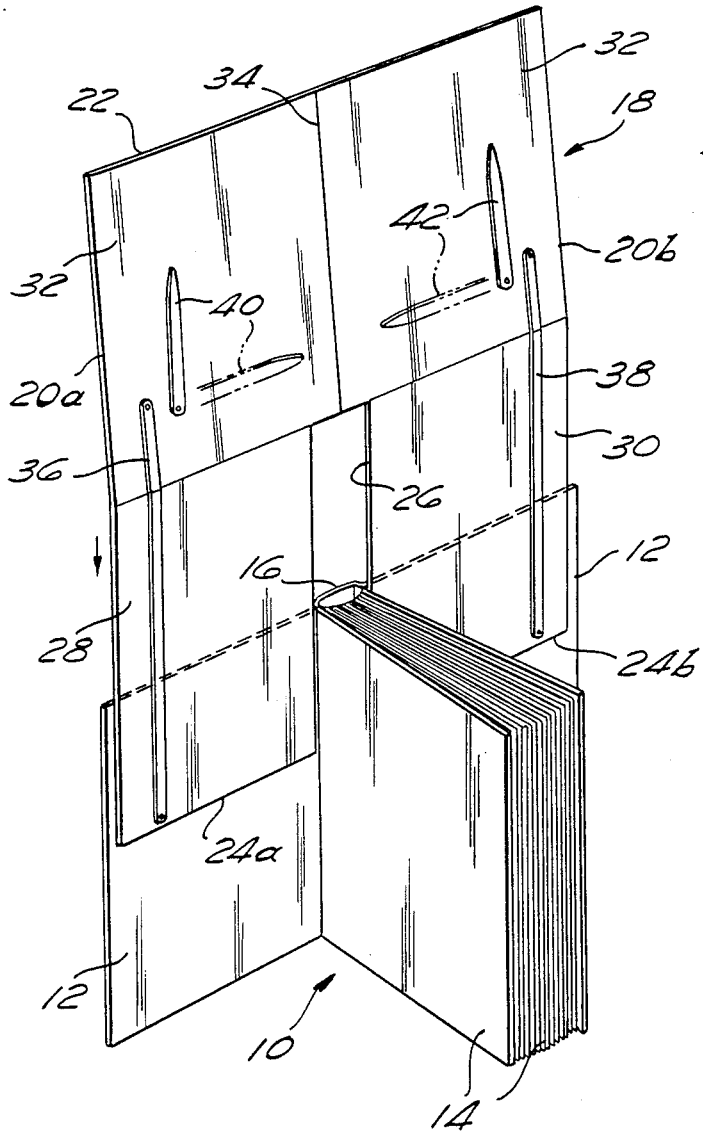
FIG. 1 is a perspective view of a book with an embodiment of a book shade of this invention partially inserted in a book.
Figure 2:
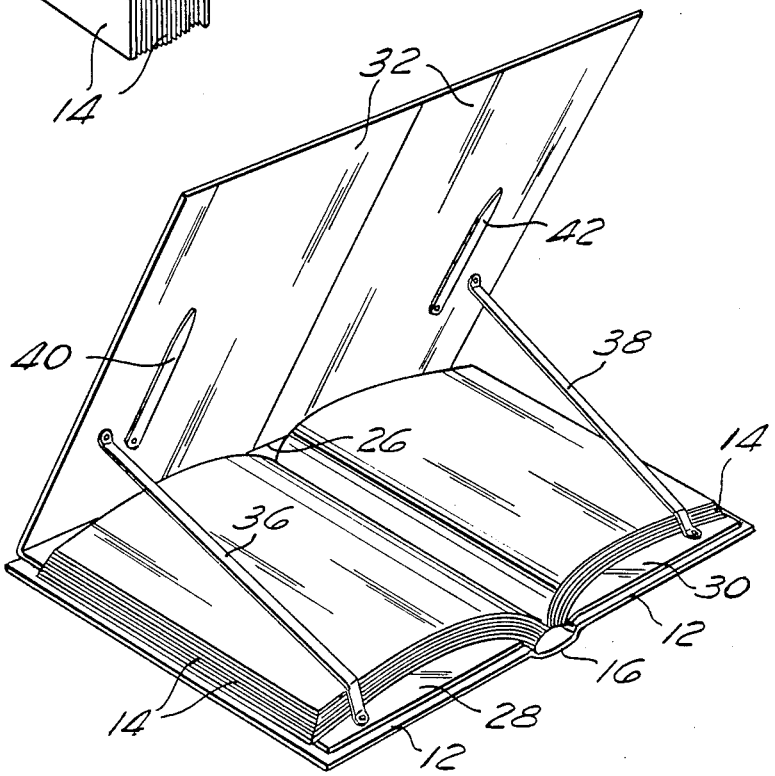
FIG. 2 is a perspective view of the book shade of FIG. 1, fully inserted into the book, and having local stiffeners on the shade.

Referring to FIGS. 1 and 2, but primarily to FIG. 1, there is shown a book 10 having covers 12 between which a plurality of pages 14 are held together by suitable means, but preferably held tightly together by binding 16. A sunshade 18 is inserted into the book 10 in a manner that will be described later. The sunshade 18 has a generally flat, rectangular shape having two generally parallel and opposing side edges 20a and *b*, which preferably have a length of about twice the height of the book cover 12. The remaining two edges of the sunshade 18 comprise a top edge 22 and bottom edges 24*a* and 24*b*.

A slot 26 is located between the bottom edges 24*a* and 24*b* at what would normally be the center of the bottom edge. The slot 26 extends towards the interior of the sunshade 18, preferably for a distance of about half the length of the edges 20. The slot 26 has a width that is preferably greater than the thickness of the stack of pages 14 adjacent the binding 16.

Thus, the bottom portion of the sunshade 18 comprises two insert flaps 28 and 30 having bottom edges 24*a* and 24*b*, respectively, and separated by slot 26. The upper portion of the sunshade 18 comprises a shade 32 bounded on the sides by edges 20*a* and 20*b*, on the top by edge 22 and on the bottom by flaps 28 and 30.

A fold line 34, oriented generally parallel to the edges 20, extends between the top edge 22 and the slot 26. Resilient members 36 and 38 connect the flaps 36 and 38 to the shade 32. Preferably, one end of the resilient members 36 and 38 is located on the flaps 28 and 30 adjacent the edges 24*a* and 24*b*. Preferably, the other end of the resilient members 36 and 38 is located on the shade 32 adjacent the juncture with the flaps 28 and 30. The resilient members 28 and 30 are preferably of elastic material so they can resiliently stretch like rubber bands.

The sunshade 18 can be connected to the book 10 by inserting the flaps 28 and 30 between the pages 14 of the book 10. Preferably, the flaps 28 and 30 are inserted between the book covers 12 and the adjacent pages 14, with the slot 26 allowing the sunshade 18 to be inserted around the intervening pages held together by binding 16. The flaps 28 and 30 are essentially sandwiched between the book cover 12 and the book pages 14 so as to hold the sunshade 18 from substantial movement, as seen in FIG. 2.

The resilient members 36 and 38 urge the shade 32 into an acute angled position with respect to book cover 12 and flaps 28 and 30. Preferably, the shade 32 can be positioned with respect to the pages 14 so as to provide a shade to the text on the pages 14 which prevents objectionable glare from the incident light source. The resilient members 36 and 38 also serve to connect the sunshade 18 to the book 10.

The resilient members 36 and 38 can be placed around selected pages 14 so as to not only urge the shade 32 into a desired position, but also to urge the selected pages 14 to remain in a position for reading. Effectively, the resilient members 36 and 38 can be used to hold the book pages 14 open to a predetermined location without having to break the binding 16 on the book 10.

Preferably, the sunshade 18 is made of a relatively thin material such as cardboard or plastic. While preferably opaque, the sunshade 18 could be translucent, or tinted and transparent, so long as it reduced the glare from the incident light. For ease of reference, the term semi-transparent will be used to refer to a sunshade 18 that is translucent, or tinted.

Referring to FIG. 2, if the size of the sunshade 18 and the material of which it is made are such that the shade 32 lacks sufficient rigidity to support itself, or to support itself against the urging of resilient members 36 and 38, local stiffeners 40 and 42 can be attached to the shade 32. The local stiffeners 40 and 42 preferably take the form of an elongated member which is rotatably fastened at one end to the shade 32 so that the stiffeners 40 and 42 can rotate in the plane of the shade 32 to which they are attached. There is thus provided a localized, positionable stiffening means.

In use, the sunshade 18 is inserted into a book 10. The book 10 is then opened to a desired location and the resilient members 36 and 38 positioned around the pages so as to hold the book 10 open at the desired location. The shade 32 is oriented at an acute angle with respect to the flaps 28 and 30 so as to block any strong incident light which cause glare into the eyes of the reader.

If needed, the stiffeners 40 and 42 can be adjusted to provide a desired amount of stiffness to help properly position the shade 32. The position of the book 10 within the slot 26 can help position the shade 32 as the pages 14 push against the shade 32. The shade 32 can also be folded along fold line 34 to help correctly position the shade 32. When reading is completed, the sunshade 18 can be removed, or the shade 32 can be placed against the book pages 14 and the book closed, with the shade 32 folding along fold line 34 within the closed pages 14 of the book 10.

There is thus advantageously provided a simple and inexpensive means of preventing glare which hinders a person from reading the text on a book. There is further advantageously provided resilient means for restraining the pages of a book during reading. There is still further provided positionable stiffening means for selectively adjusting the stiffness of the shade so as to aid in positioning the shade to block the offending glare during reading.

Referring to FIG. 3, there is shown a further embodiment of this invention wherein the book shade connects to the book 10 through use of a container 44 which holds the book 10. The container 44 generally comprises a top cover 46 and a bottom cover 48 rotatably joined along a hinge line 50. The top and bottom covers 46 and 48 are connected to the hinge line 50 in an offset manner such that the covers 46 and 48 can be placed in a substantially parallel, but spaced apart, position. The covers 46 and 48 are generally flat, rectangular in shape and sized slightly larger than an opened book 10 placed between the covers 46 and 48.

Positioning means allow the top cover 46 to be selectively positioned and held at an angle with respect to the bottom cover 48. Preferably, the positioning means take the form of friction tabs 52 and 54 connected to the covers 46 and 48, respectively, adjacent the hinge line 50. The tabs 52 and 54 are positioned in frictional contact with each other so as to provide a sufficient frictional force to support the weight of the top cover 46 when the cover 46 is positioned at a desired location. To increase the position holding ability of tabs 52 and 54, a series of notches or serrations 55 can be placed in the abutting surfaces of tabs 52 and 54. Thus, tabs 52 and 54 provide frictional positioning means for positioning the top cover 46 relative to the bottom cover 48.

Resilient means, such as springs 56 are connected to the bottom cover 48. The springs 56 preferably comprise spring clips which are made of formed sheet metal in any of a number of widths. The springs 56 are located on adjacent sides of bottom cover 48 to facilitate placing a book 10 so the pages 14 can be held by the springs 56.

In use, a book 10 is opened and placed inside the bottom cover 48. The springs 56 hold the pages 14 of the open book 10 from turning. The tabs 52 and 54 allow the top cover 46 to be positioned at any desired orientation so as to provide a sunshade which shades the text on the pages 14 from objectionable glare from the reading light. When reading is completed, the top cover 46 can be placed against the open pages 14 of the book 10 so it is substantially parallel with the bottom cover 48.

The container 44 is preferably made of a thin plastic material. The container 44 not only protects the book 10, but provides a positionable top cover 46 which can be used as a sunshade. While preferably opaque, the top cover 46 can be made of a transparent, translucent, or tinted material so as to only partially block any incident light and provide a lighter shade to the printed text on the book 10. The container 44 is designed to hold an open book, rather than a closed book, as with conventional book covers. The container 44 could also be used as an attractive yet functional means for displaying a book 10, yet facilitating reading of that book when desired.

Still referred to FIG. 3, there are shown sides 58 a and b, which are oriented substantially perpendicular to the covers 46 and 48, and which extend around the periphery of covers 46 and 48. Preferably, the sides **58*a* on the top cover 46 cooperate with the sides 58*b* on the bottom cover 48 so as to substantially enclose a book 10 placed inside the container 44 when the covers 46 and 48** are placed in a closed position.

FIG. 4 illustrates a container 44 in which the sides **58*b* on the bottom cover 48 are stepped inward to form an interlocking edge 60 which cooperates with the side 58*a* on the top cover 46 to form an interlocking fit when the container 44 is closed. In this embodiment, a portion of the side 58*a* binds against the edge 60 adjacent the rotational hinge line 50, so as to position and hold the top cover 46** in a predetermined position.

An alternate embodiment of the container 44 is shown in FIG. 5. The bottom cover 48 has sides **58*b* substantially surrounding the periphery of the bottom cover 48. Adjacent one corner of the bottom cover 48, however, there is a gap or aperture 62 in the sides 58*b*. Two resilient members such as springs 56 are again provided on two adjacent sides of the bottom cover 48**.

In this embodiment, the top cover 46 takes the form of a substantially flat, rectangular piece of material, preferably plastic. One edge of the top cover 46 is inserted into a first aperture, such as first slot 66 along one side of the bottom cover 48. The first slot 66, is oriented at an angle with respect to the plane of the bottom cover 48, so that the top cover 46 is held at a predetermined acute angle with respect to the bottom cover 48.

When a book 10 is inserted into the bottom cover 48 of container 44, the springs 56 connect the book 10 to the container 44, and further hold the pages 14 of the book open at a selected location. The top cover 46 again provides a shade which, in this embodiment, is held at a substantially predetermined orientation.

The side **58*b* of the bottom cover 48, located opposite the juncture of the top cover 46 and bottom cover 48, contains a second aperture such as a second slot 64 which opens toward the juncture of the top cover 46 and bottom cover 48. The top cover 46 is sufficiently flexible so that the container 44 can be closed by inserting one edge of the top cover 46 into the slot 64, which retains the top cover 46 in a closed position. A person can reach into the aperture 62 to facilitate removal of the top cover 46 from the closed position, and to also facilitate turning the pages 14**.

In a further embodiment, there is yet a third slot 68 located along one side **58*b* of the bottom cover 48. The third slot 68 is substantially opposite to, and opens toward, first slot 64. In this embodiment, one edge of the top cover 46 is removably inserted into the first slot 66 so the top cover 46 is held in a first, shaded position for use as a sunshade. The top cover 46 is removed from slot 66 and inserted into the slots 64 and 68 so that opposing edges of the top cover 46 are held by slots 64 and 68. The slots 64 and 68 have one end accessible from the side so that the top cover 46 can be slid along the length of the slots 64 and 68 from one end of the slots. The slots 64 and 68 are preferably adjacent the external portion of the sides 58***b* so that the top cover 46 is substantially adjacent the book 10 inserted into the container 44.

Thus, in this embodiment, the top cover 46 is removably positioned to be used as either a sunshade or as a cover. This particular configuration allows the book 10 to not only be displayed, but if the top cover 46 is transparent, the book 10 can be read while the container 44 is closed. Alternately, the top cover 46 can be inserted into the shade position and the second slot 66 so as to provide a sunshade.

A still further embodiment of this invention, is shown in FIG. 6, wherein the top cover 46 is joined to the bottom cover 48 along one edge. Two springs 56 on opposite edges of the bottom cover 48 provide retention means for holding a book 10 open at a predetermined page 14. In this embodiment, the springs 56 are shown as torsion springs.

Two angle brackets 70 are connected to the bottom cover 48 along the edge which joins to the top cover 46. The angle brackets 70 comprise a strip of material bent in an angle, with the two ends of the angle being connected to the bottom cover 48, and with one leg of the angle being substantially at the juncture of the top cover 46 and bottom cover 48. The top cover 46 rests against the side of the angle brackets 70 such that the angle between the legs of the angle bracket 70 determines the orientation of the top cover 46 with respect to the bottom cover 48. Thus, the angle brackets 70 can effectively determine the angle of the top cover 46 which acts as a sunshade.

The top cover 46 is preferably made of sufficiently flexible material that it can be placed into a substantially parallel position with respect to bottom cover 48. A clasp can hold the top cover 46 in the closed position. A simple clasp is shown as comprising an elastic member 72 having one end connected to the bottom cover 48 and a loop 74 on the opposing end. A projection 76 is connected to the top cover 46 such that when the top cover 46 is placed adjacent the bottom cover 48, the loop 74 can engage the projection 76 to hold the top cover 46 in the closed position.

There is thus provided a means for containing a book in an open position and for restraining the pages of the book in a predetermined open position. The container protects the book, and further provides means for shading the text of the book so as to inhibit glare. The containing means can be further used to provide an attractive display for an open book, while simultaneously providing a functional reading apparatus to reduce glare from the reading light.

We claim:

1. A book shade for holding an open book having a plurality of pages, and shading the pages from incident light, comprising:

a top cover and bottom cover rotatably connected together adjacent a first edge of the covers, the covers being sized substantially the same as an open book of predetermined dimensions when the covers are substantially parallel to one another in a closed position; and positioning means for holding the top cover in at least one selected position at an acute angle with respect to the bottom cover in order to block light incident on the pages of an open book placed between the covers; and resilient retaining means connected to said bottom cover for retaining the pages of a book placed on said bottom cover open at selectable pages by resiliently urging a portion of the open book against the bottom cover when said top cover is at an acute angle with respect to the bottom cover.

2. A book shade as defined in claim 1 wherein at least a substantial portion of the cover is semitransparent.

3. A book shade as defined in claim 2, further comprising sides on the top and bottom covers cooperating with the covers to form a container substantially enclosing an open book placed between the covers when the covers are in the closed position.

* * * * *